US011148759B2

(12) United States Patent
Hicks

(10) Patent No.: US 11,148,759 B2
(45) Date of Patent: Oct. 19, 2021

(54) STERN-SUSPENDED STORAGE COMPARTMENT FOR KAYAKS

(71) Applicant: Mark A. Hicks, Phoenix, AZ (US)

(72) Inventor: Mark A. Hicks, Phoenix, AZ (US)

( * ) Notice: Subject to any disclaimer, the term of this patent is extended or adjusted under 35 U.S.C. 154(b) by 9 days.

(21) Appl. No.: 16/683,161

(22) Filed: Nov. 13, 2019

(65) Prior Publication Data

US 2020/0164949 A1 May 28, 2020

Related U.S. Application Data

(60) Provisional application No. 62/770,974, filed on Nov. 23, 2018.

(51) Int. Cl.

| | |
|---|---|
| ***B63B 25/00*** | (2006.01) |
| ***B63B 21/58*** | (2006.01) |
| ***B63B 19/14*** | (2006.01) |
| ***B63B 34/20*** | (2020.01) |
| *B63B 34/26* | (2020.01) |

(52) U.S. Cl.

CPC ..... *B63B 25/002* (2013.01); *B63B 19/14* (2013.01); *B63B 21/58* (2013.01); *B63B 34/20* (2020.02); *B63B 34/26* (2020.02)

(58) Field of Classification Search

CPC ..... B63B 25/00; B63B 25/002; B63B 34/00; B63B 34/20; B63B 34/26; B63B 19/00; B63B 19/14; B63B 21/00; B63B 21/58

USPC ..... 114/343, 347, 364

See application file for complete search history.

(56) References Cited

U.S. PATENT DOCUMENTS

| | | | | |
|---|---|---|---|---|
| 6,276,290 | B1 | 8/2001 | Yamada | |
| 6,367,403 | B1 | 4/2002 | Carter | |
| 6,755,145 | B2 * | 6/2004 | Bolebruch | B63B 34/20 114/347 |
| 6,793,106 | B1 | 9/2004 | Kerry | |
| 6,840,190 | B2 * | 1/2005 | Godek | B63B 34/20 114/347 |
| 6,860,223 | B2 * | 3/2005 | Lee | B63B 34/20 114/364 |
| 7,255,053 | B2 * | 8/2007 | Hopper | E05C 3/06 114/78 |
| 7,377,223 | B2 | 5/2008 | Toupin | |
| 7,581,506 | B2 | 9/2009 | Whitney | |
| 2006/0032422 | A1 | 2/2006 | McDermott | |

* cited by examiner

*Primary Examiner* — Lars A Olson

(74) *Attorney, Agent, or Firm* — Runyan Law; Charles Runyan

(57) ABSTRACT

A storage-container includes a hollow compartment with a storage-cover sealing a watertight interior space. The storage-container is able to be coupled to a stern of a kayak to provide an auxiliary storage compartment for the kayak. The compartment is a unitary, rigid component having a right-fin and a left-fin which extend forwardly on either side of the kayak stern, and a peaked-terminus at the back end where the right-fin and the left-fin recede to. Between the right-fin and the left-fin at the front side adjacent to the stern of the kayak is a concavity to accommodate the stern. The interior compartment inhabits both the right-fin and the left-fin, being centered between. The storage-port opens into this interior compartment. A fastener aperture is vertically oriented near the concavity to enable a fastener to connect the container to the kayak stern.

13 Claims, 5 Drawing Sheets

STERN-SUSPENDED STORAGE COMPARTMENT FOR KAYAKS

CROSS-REFERENCE TO RELATED APPLICATION(S)

The present application is related to and claims priority to U.S. Provisional Patent Application No. 62/770,974 filed Nov. 23, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of storage of existing art and more specifically relates to watercraft storage accessories.

RELATED ART

There is a lack of watertight storage space on a kayak. Many recreationalists employ the use of a tow rope to pull ice chests and other storage boxes behind the kayak. These tow ropes tend to become tangled or caught on rocks on vegetation. In addition, items towed with a rope will often flip in choppy water. Some kayaks include integrated storage, but this is often not suitably large enough, and robs space in the kayak from the operator's seating. A suitable solution is desired.

U.S. Pat. No. 6,793,106 to Parker Kerry relates to a bow-stern canoe box. The described bow-stern canoe box includes a removable, storage box for use within a canoe or other small boat. The shape of the box is such that it fits securely within the tapered bow or stem of a canoe or any watercraft having adequately shaped bow and/or stern regions, without degrading the watercraft's stability or seaworthiness. The key to the utility of the box is that because of its overall shaped it can be wedged in between the watercraft's floor and the underside of its gunwale flanges. Once the box is so situated, its wedged fit holds it in place both for water travel; during portaging, it can be removed for carrying on one's back or it can be left in place to be carried along with the canoe. Also, because of the wedge fit, the lid of the box is held firmly closed during travel by the gunwale flanges. Because of the thermal insulation of the box, this tight closure of the lid allows either hot or cold items to be transported without their undergoing undesired temperature changes.

SUMMARY OF THE INVENTION

In view of the foregoing disadvantages inherent in the known watercraft storage accessory art, the present disclosure provides a novel stern-suspended storage compartment for kayaks. The general purpose of the present disclosure, which will be described subsequently in greater detail, is to provide a stern-suspended storage compartment for kayaks.

A storage-container is disclosed herein. The storage-container includes a hollow compartment with a storage-cover sealing a watertight interior space. The storage-container is able to be coupled to a stern of a kayak to provide an auxiliary storage compartment for the kayak. The compartment is a unitary, rigid component having a right-fin and a left-fin which extend forwardly on either side of the kayak stern, and a peaked-terminus at the back end where the right-fin and the left-fin recede to. Between the right-fin and the left-fin at the front side adjacent to the stern of the kayak is a concavity to accommodate the stern. The interior compartment inhabits both the right-fin and the left-fin, being centered between. The storage-port opens into this interior compartment. A fastener aperture is vertically oriented near the concavity to enable a fastener to connect the container to the kayak stern.

According to another embodiment, a method for adding storage space to a kayak is also disclosed herein. The method for adding storage space to a kayak includes providing the above-described storage-container, placing the storage-container rearwardly to the kayak, aligning the fastener-aperture and a fastener with a hole in the stern of the kayak, inserting the fastener through both the fastener-aperture and the stern of the kayak, and threading the fastener to attach the storage-container to the kayak.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a stern-suspended storage compartment for kayaks, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a watercraft storage accessory and more particularly to a stern-suspended storage compartment for kayaks as used to improve the storage capacity of a kayak.

Generally, the present invention provides a watertight compartment for a kayak to afford additional storage space for a tent, food, or other important supplies for an outing. The device attaches securely to the kayak to offer safe and convenient storage for any necessity that may be needed. It eliminates the need to use a tow rope and prevents the towed items from tipping in choppy waters. The device ensures that items in the compartment remain dry and in good condition. The present invention allows users to easily access the contained items during the outing. Kayaktail is a storage receptacle attachable to a watercraft, specifically a kayak. The storage receptacle is V-shaped and fits neatly into the stern area of the kayak. The storage receptacle may include a hook-like member that is threadable through a hole in the kayak to attach the compartment to the kayak. A specially designed stainless steel J bolt would be needed so that users may hitch the unit to the kayak. Bungee-cords may be used to secure the unit in transport. The size of the unit will vary based on the size and brand of kayak. The exact specification may vary.

For the purpose of this specification, the term "seal" is used to mean causing a watertight seal. The term "proximal" is used to mean proximal to a stern of the kayak when the storage container is properly installed to the stern of the kayak unless otherwise referenced in relation to a component. The term "distal" is used to mean distal to a stern of the kayak when the storage container is properly installed to the stern of the kayak unless otherwise referenced in relation to a component. When an element is described as "acute", it is angularly acute. For example, the right-terminus and the left-terminus are each acute in a preferred embodiment in that the angle defining the terminus is less than ninety degrees.

Referring now more specifically to the drawings by numerals of reference, there is shown in FIGS. 1-4, various views of a storage-container 100.

Figure 1:
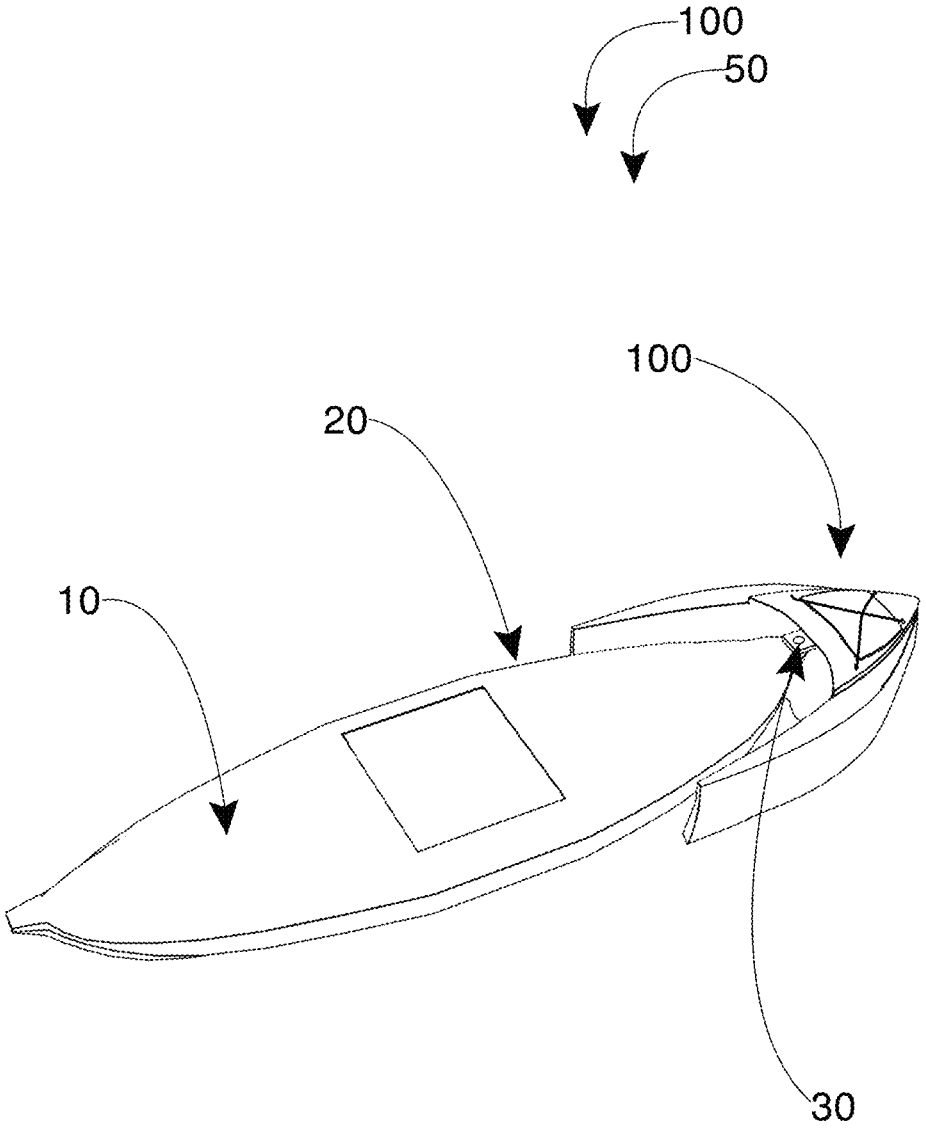
FIG. 1 is a perspective view of the storage-container attached to a kayak during an 'in-use' condition, according to an embodiment of the disclosure.

FIG. 1 shows a storage-container during an 'in-use' condition 50, according to an embodiment of the present disclosure. Here, the storage-container may be beneficial for use to add storage space to a kayak. As illustrated, storage-container 100 may be able to be coupled to stern 20 of kayak 10.

Figure 2:
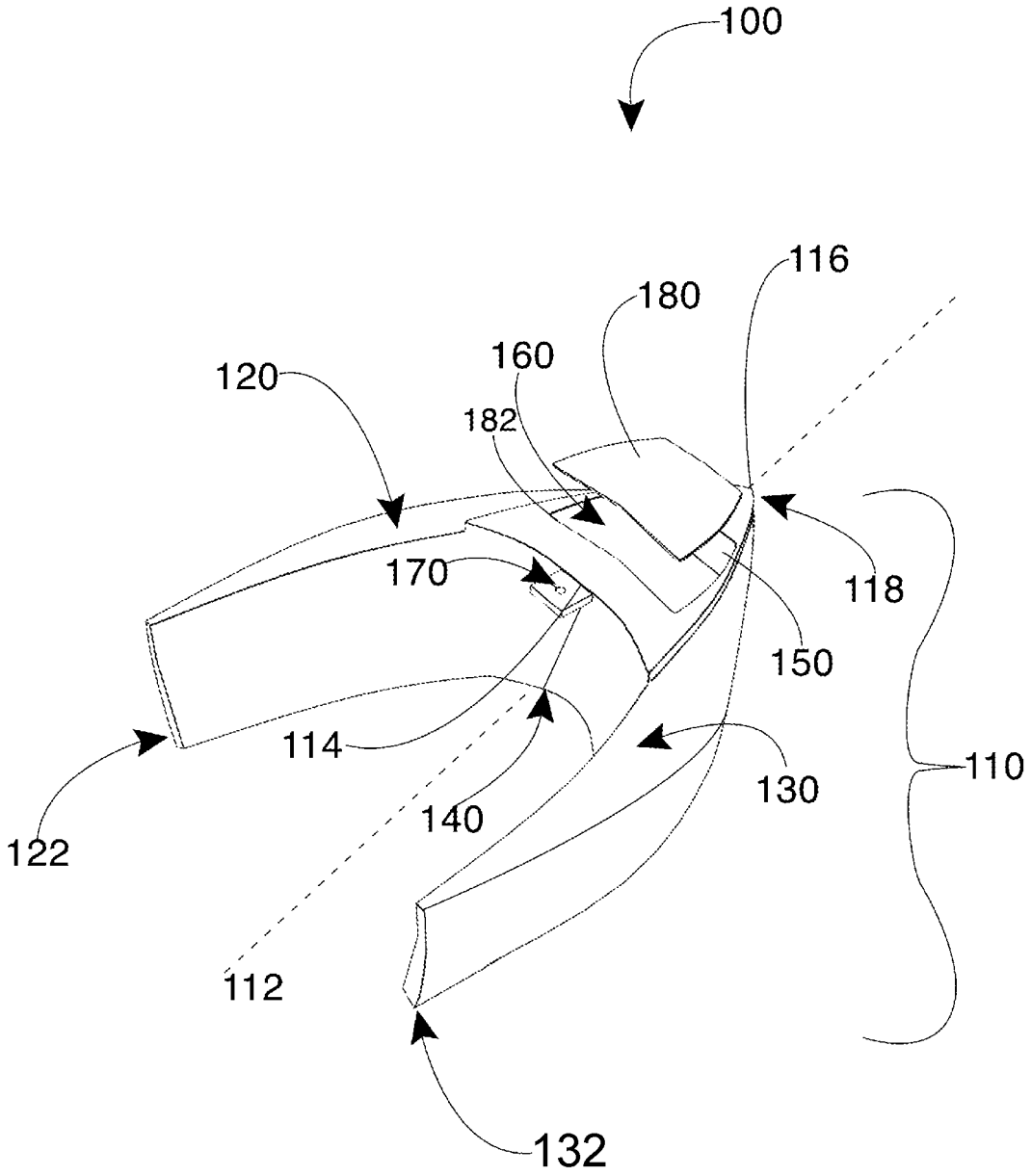
FIG. 2 is a detailed top perspective view of the storage-container of FIG. 1, according to an embodiment of the present disclosure.

FIG. 2 shows the storage-container 100 of FIG. 1, according to an embodiment of the present disclosure. Storage-container 100 may include compartment 110 and storage-cover 180. Compartment 110 may be a unitary component and may be substantially rigid. In a preferred embodiment, compartment 110 may be constructed of injection molded plastic. Compartment 110 may itself having right-fin 120, left-fin 130 mirroring right-fin 120, peaked-terminus 118, concavity 140, interior compartment 150, storage-port 160, and fastener-aperture 170. Right-fin 120 may end in acute right-terminus 122. Likewise, left-fin 130 may end in acute left-terminus 132, such that left-fin 130 mirrors right-fin 120 over compartment-centerline 112 as illustrated. Peaked-terminus 118 may be located at distal-end 116 of compartment-centerline 112 where right-fin 120 and left-fin 130 meet. Concavity 140 may be located at proximal-end 114 of compartment-centerline 112 where right-fin 120 and left-fin 130 meet. Concavity 140 being defined by the contour of right-terminus 122, proximal-end 114 of compartment-centerline 112, and left-terminus 132. Preferably, interior-compartment 150 inhabits both right-fin 120 and left-fin 130 as a unitary inner volume. However, in some embodiments, interior-compartment 150 may be subdivided. For example, interior-compartment 150 may be divided into a right volume and a left volume with either a single or separate ingress points. Storage-port 160 may perforate interior-compartment 150, so that interior-compartment 150 can be accessed from outside container 110. Fastener-aperture 170 may be disposed proximate to concavity 140. Fastener-aperture 170 may not perforate interior-compartment 150. Storage-cover 180 is able to fasten to and seal closed storage-port 160, such that storage-cover 180 is watertight against interior-compartment 150 when coupled to storage-port 160, interior-compartment 150 being watertight when storage-cover 180 is fastened to storage-port 160. Right-fin 120 and left-fin 130 may be each characterized by curvatures that are concave toward each other. Storage-container 100 may further include gasket 182 affixed to compartment 110. Gasket 182 may circumscribe storage-port 160. Gasket 182 may be of a construction able to seal storage-cover 180 to compartment 110 over storage-port 160 when storage-cover 180 is fastened to storage-port 160. Gasket 182 may be rubber, polyurethane, or another deformable and resilient material suitable for forming watertight gaskets.

Storage-container 100 may further include pair of bungee-cords. Pair of bungee-cords 230 may be mounted to compartment 110, with one of pair of bungee-cords being mounted to the right fin, and the other of pair of bungee-cords being mounted to left-fin 130. Additionally, storage-container 100 may also include at least one bungee-cord-fastener mounted to compartment 110. Each of pair of bungee-cords may be able to be stretched over storage-cover 180 and affixed to at least one bungee-cord-fastener to retain storage-cover 180 to storage-port 160.

Figure 3:
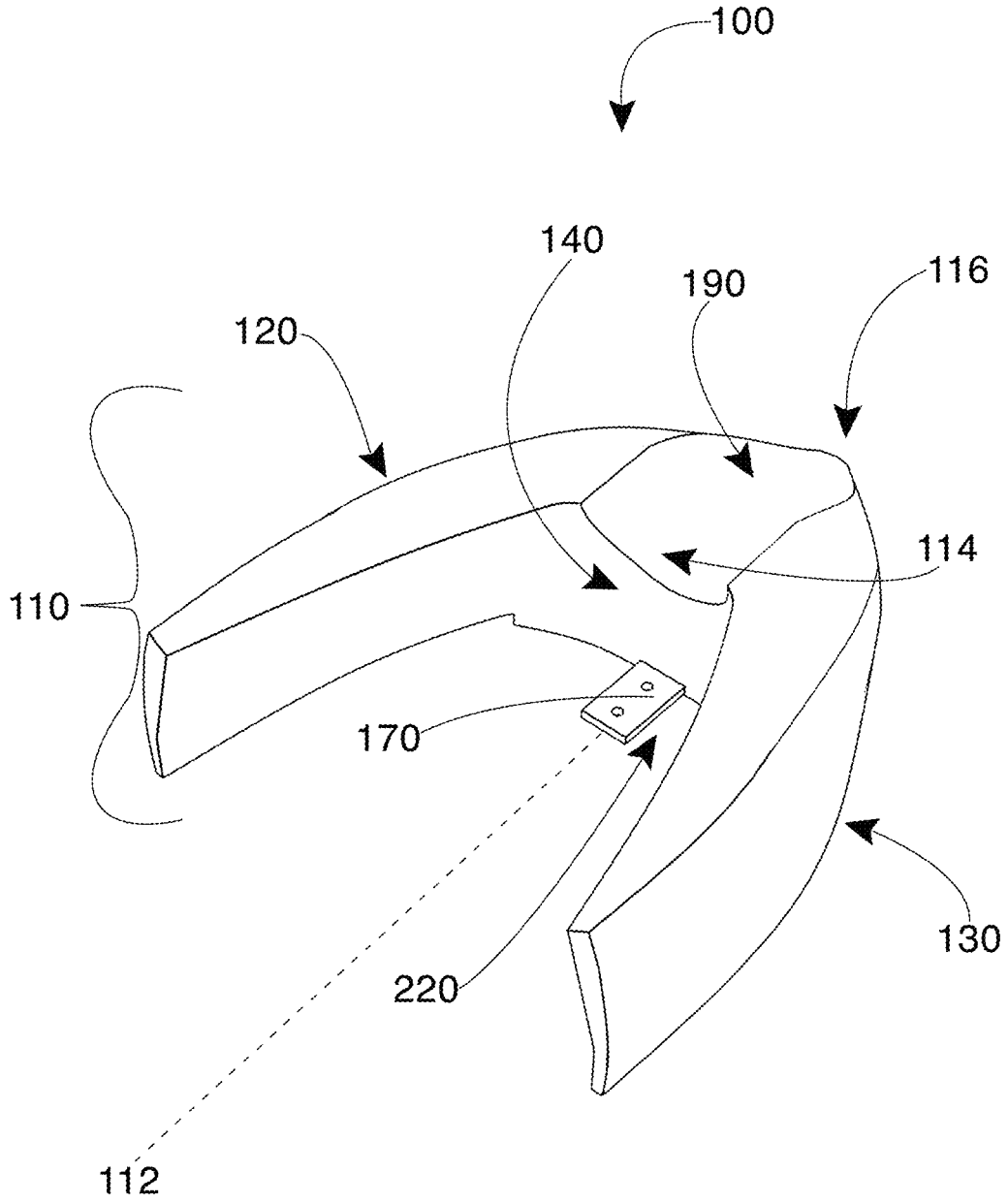
FIG. 3 is a bottom perspective view of the storage-container of FIG. 1, according to an embodiment of the present disclosure.

FIG. 3 is a bottom perspective view of the storage-container 100 of FIG. 1, according to an embodiment of the present disclosure. Storage compartment 100 may further include channel 190 which runs between right-fin 120 and left-fin 130 and follows compartment-centerline 112. Channel 190 may extend from proximal-end 114 to distal-end 116. Channel 190 is disposed on a side of compartment 110 which is opposite storage-port 160 (FIG. 2). When storage-compartment 100 is installed on kayak 10 (FIG. 1), channel 190 is disposed on a bottom side of storage-compartment 100. In use, channel 190 may be submerged underwater. Channel 190 provides an aerodynamic passage for water to pass through when water is forced into the gaps on either side caused by right-fin 120 and left-fin 130 being separated from stern 20 (FIG. 1) of kayak 10 (FIG. 1). Preferably, right-fin 120 and left-fin 130 are each contoured convexly on either side of compartment-centerline 112 to form channel 190, such that right-fin 120 and left-fin 130 together buttress channel 190, as illustrated.

Compartment 110 may further include straight flange 220. Straight-flange 220 may protrude from compartment-centerline 112 outwardly and from concavity 140 between right-fin 120 and left-fin 130. Straight flange 220 may be colinear with compartment-centerline 112. Preferably, fastener-aperture 170 perforates straight flange 220. In this way, fastener-aperture 170 in combination with straight flange 220 forms the mounting point for storage-container 100 to affix and be suspended from kayak 10 (FIG. 1). Straight flange 220 may be long enough to displace storage-container 100 rearwardly from stern 20 (FIG. 1) of kayak 10 (FIG. 1), so that while straight flange itself may partially rest upon stern 20 (FIG. 1), container 110 sits behind stern 20 (FIG. 1). In some embodiments, straight flange 220 may be shaped rectangularly, or as a rectangular cuboid.

Figure 4:
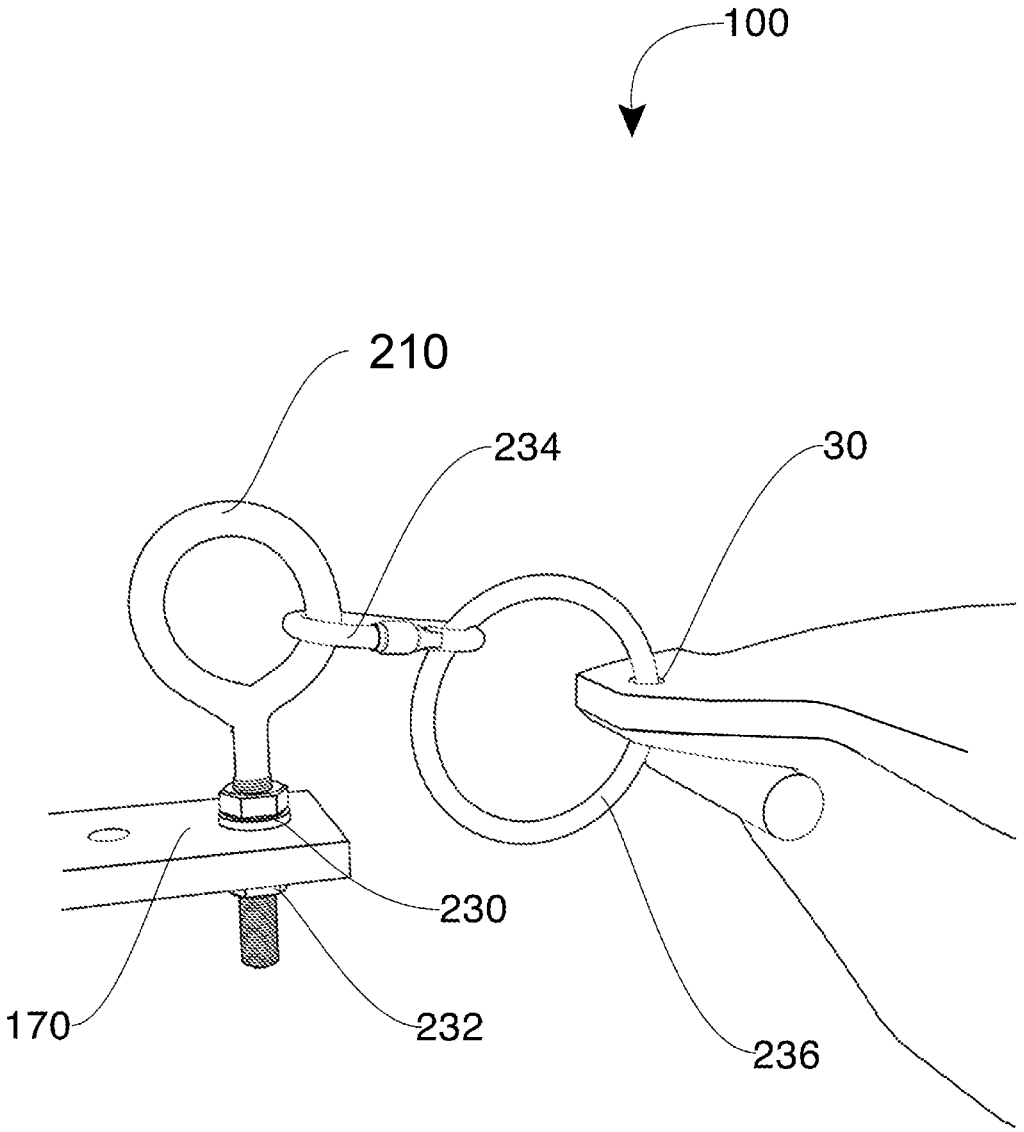
FIG. 4 is a perspective view of optional fasteners for the storage-container of FIG. 1, according to an embodiment of the present disclosure.

FIG. 4 is a perspective view of an embodiment of the fasteners of the storage-container 100 of FIG. 1, according to an embodiment of the present disclosure. Storage-container 100 may include I-bolt 210, at least one washer 230, at least one nut 232, link 234, and ring 236. I-bolt 210 may be sized to pass through kayak stern carrying handle hole 30 (or fastener-aperture 170) and be secured with at least one washer 230 and at least one nut 232. Ring 236 may pass through fastener-aperture 170 (or kayak stern carrying handle hole 30). Lastly, link 234 may fasten I-bolt 210 to ring 236. In this way, kayak 10 (FIG. 1) may be secured to storage container 100. Ring may be any linking device. Ring 236 may be rigid or non-rigid. In one exemplary embodiment, ring 236 is a corded carry handle. Link 234 may be a releasable fastener, such as a spring snap link, spring carabiner, or threaded locking carabiner (as illustrated), which enables quick and convenient coupling and decoupling of kayak 10 (FIG. 1) from storage-container 100. This system also provides multiple points of articulation and flexibility so that storage-container 100 may be pulled behind kayak 10 (FIG. 1) and float independently without being rigidly affixed to kayak 10 (FIG. 1).

In one alternative embodiment, storage-container 100 may include a U-shaped fastener. U-shaped fastener may be composed of an extension-member, a tail-link angled relative to extension-member, and a boat-link angled relative to extension-member, U-shaped fastener being unitary and substantially rigid. Extension-member, tail-link, and boat-link may be integral to each other. Preferably, U-shaped fastener is a unitary forged steel component. Tail-link and boat-link may be parallel to each other. Boat-link may be threaded to receive nut in order to fasten to kayak stern carrying handle hole 30 of kayak 10, as illustrated. Tail-link may be riveted to fastener-aperture 170. Alternative fastening methods may be used.

Figure 5:
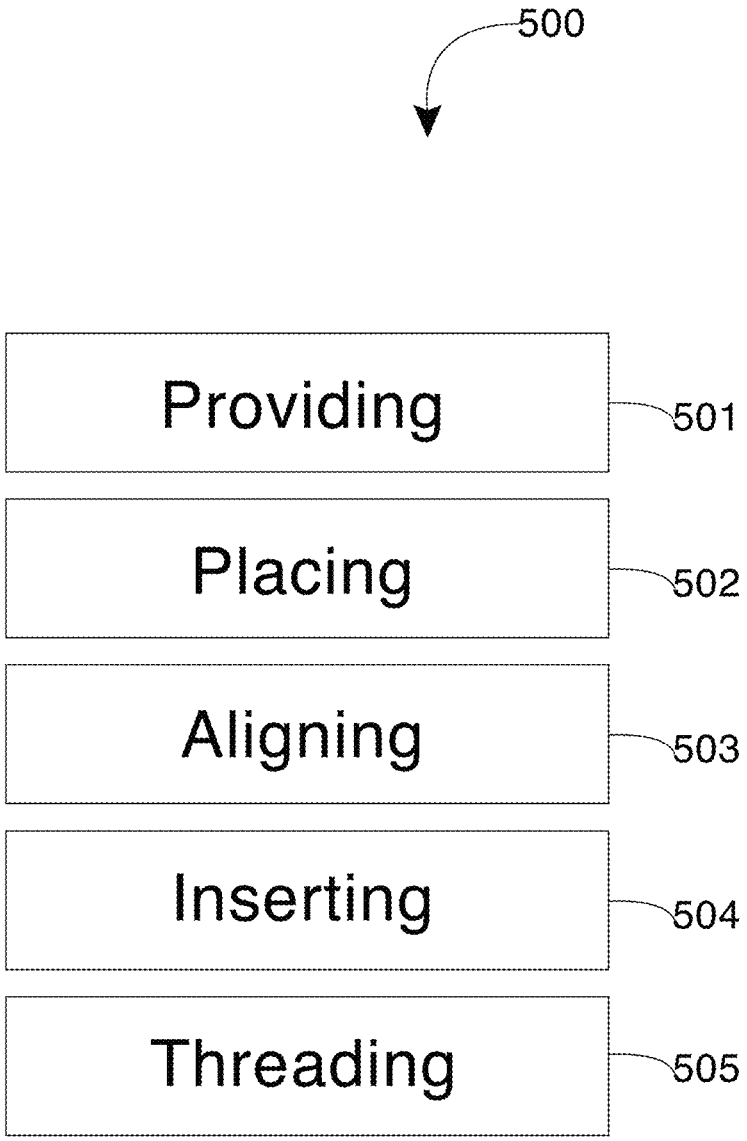
FIG. 5 is a flow diagram illustrating a method of use for adding storage to a kayak, according to an embodiment of the present disclosure.

FIG. 5 is a flow diagram illustrating a method for adding storage to a kayak, according to an embodiment of the present disclosure. In particular, the method for adding storage to a kayak 500 may include one or more components or features of the storage-container 100 as described above. As illustrated, the method for adding storage space to a kayak 500 may include the steps of: step one 501, providing a storage-container able to be coupled to a stern of a kayak, the storage-container comprising a compartment which is unitary and substantially rigid, the compartment having a right-fin having an acute right-terminus, a left-fin having an acute left-terminus, the left-fin mirroring the right-fin over a compartment-centerline, a peaked-terminus at a distal-end of the compartment-centerline where the right-fin and the left-fin meet; a concavity at a proximal-end of the compartment-centerline where the right-fin and the left-fin meet, the concavity being defined by the contour of the right-terminus, the proximal-end of the compartment-centerline, and the left-terminus; an interior-compartment inhabiting both the right-fin and the left-fin, a storage-port perforating the interior-compartment; and a fastener-aperture proximate to the concavity, the fastener-aperture not perforating the interior-compartment; and a storage-cover able to fasten to and seal closed the storage-port, such that the storage-cover is watertight against the interior-compartment when coupled to the storage-port, the interior-compartment being watertight when the storage-cover is fastened to the storage-port; step two 502, placing the storage-container rearwardly to the kayak; step three 503, aligning the fastener-aperture and a fastener with a hole in the stern of the kayak; and step four 504, inserting the fastener through both the fastener-aperture and the stern of the kayak; and step five 505, threading the fastener to attach the storage-container to the kayak.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for adding storage space to a kayak, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A storage-container able to be coupled to a stern of a kayak, the storage-container comprising:

a compartment which is unitary and substantially rigid, the compartment having a right-fin having an acute right-terminus, a left-fin having an acute left-terminus, the left-fin mirroring the right-fin over a compartment-centerline, a peaked-terminus at a distal-end of the compartment-centerline where the right-fin and the left-fin meet;

a concavity at a proximal-end of the compartment-centerline where the right-fin and the left-fin meet, the concavity being defined by the contour of the right-terminus, the proximal-end of the compartment-centerline, and the left-terminus;

an interior-compartment inhabiting both the right-fin and the left-fin, a storage-port perforating the interior-compartment; and a fastener-aperture proximate to the concavity, the fastener-aperture not perforating the interior-compartment;

a U-shaped fastener having an extension-member, a tail-link angled relative to the extension-member, and a boat-link angled relative to the extension-member, the U-shaped fastener being unitary and substantially rigid and a storage-cover able to fasten to and seal closed the storage-port, such that the storage-cover is watertight against the interior-compartment when coupled to the storage-port, the interior-compartment being watertight when the storage-cover is fastened to the storage-port, wherein the right-fin and the left-fin are each characterized by curvatures that are concave toward each other.

2. The storage-container of claim 1, wherein the tail-link and the boat-link are parallel to each other.

3. The storage-container of claim 1, wherein the boat-link is threaded to receive a nut in order to fasten to a kayak stern carrying handle hole.

4. The storage-container of claim 1, wherein the tail-link is riveted to the fastener-aperture.

5. The storage-container of claim 1, further comprising a gasket affixed to the compartment, the gasket circumscribing the storage-port, the gasket being of construction to seal the storage-cover to the compartment over the storage-port when the storage-cover is fastened to the storage-port.

6. The storage-container of claim 1, further comprising a channel between the right-fin and the left-fin which follows the compartment-centerline which extended from the proximal-end to the distal-end.

7. The storage-container of claim 6, wherein the channel is disposed on a side of the compartment which is opposite the storage-port.

8. The storage-container of claim 1, further comprising an eyebolt sized to pass through the fastener-aperture, such that the eyebolt may be able to pass through both the fastener-aperture and a kayak stern carrying handle hole to fasten the storage-container to the kayak.

9. The storage-container of claim 1, wherein the compartment further comprises a straight flange protruding from the compartment-centerline outwardly from the concavity between the right-fin and the left-fin, the straight flange being colinear with the compartment-centerline.

10. The storage-container of claim 9, wherein the fastener-aperture perforates the straight flange.

11. The storage-container of claim 1, further comprising a pair of bungee-cords mounted to the compartment, one of the pair of bungee-cords being mounted to the right fin, and the other of the pair of bungee-cords being mounted to the left-fin, and further comprising at least one bungee-cord-fastener mounted to the compartment, such that each of the pair of bungee-cords can be stretched over the storage-cover and affixed to the at least one bungee-cord-fastener to retain the storage-cover to the storage-port.

12. A kayak storage accessory able to be coupled to a stern of a kayak, the kayak storage accessory comprising:

a compartment which is unitary and substantially rigid, the compartment having a right-fin having an acute right-terminus, a left-fin having an acute left-terminus, the left-fin mirroring the right-fin over a compartment-centerline, a peaked-terminus at a distal-end of the compartment-centerline where the right-fin and the left-fin meet;

a concavity at a proximal-end of the compartment-centerline where the right-fin and the left-fin meet, the concavity being defined by the contour of the right-terminus, the proximal-end of the compartment-centerline, and the left-terminus;

an interior-compartment inhabiting both the right-fin and the left-fin, a storage-port perforating the interior-compartment;

and a fastener-aperture proximate to the concavity, the fastener-aperture not perforating the interior-compartment;

and a storage-cover able to fasten to and seal closed the storage-port, such that the storage-cover is watertight against the interior-compartment when coupled to the storage-port, the interior-compartment being watertight when the storage-cover is fastened to the storage-port;

wherein the right-fin and the left-fin are each characterized by curvatures that are concave toward each other;

further comprising a gasket affixed to the compartment, the gasket circumscribing the storage-port, the gasket being of construction to seal the storage-cover to the compartment over the storage-port when the storage-cover is fastened to the storage-port;

further comprising a channel between the right-fin and the left-fin which follows the compartment-centerline which extended from the proximal-end to the distal-end;

wherein the channel is disposed on a side of the compartment which is opposite the storage-port;

wherein the compartment further comprises a straight flange protruding from the compartment-centerline outwardly from the concavity between the right-fin and the left-fin, the straight flange being colinear with the compartment-centerline;

wherein the fastener-aperture perforates the straight flange; and further comprising a pair of bungee-cords mounted to the compartment, one of the pair of bungee-cords being mounted to the right fin, and the other of the pair of bungee-cords being mounted to the left-fin, and further comprising at least one bungee-cord-fastener mounted to the compartment, such that each of the pair of bungee-cords can be stretched over the storage-cover and affixed to the at least one bungee-cord-fastener to retain the storage-cover to the storage-port.

13. A method of affixing a storage-container to a kayak comprising the steps of:

providing a storage-container able to be coupled to a stern of a kayak, the storage-container comprising a compartment which is unitary and substantially rigid, the compartment having a right-fin having an acute right-terminus, a left-fin having an acute left-terminus, the left-fin mirroring the right-fin over a compartment-centerline, a peaked-terminus at a distal-end of the compartment-centerline where the right-fin and the left-fin meet;

a concavity at a proximal-end of the compartment-centerline where the right-fin and the left-fin meet, the concavity being defined by the contour of the right-terminus, the proximal-end of the compartment-centerline, and the left-terminus;

an interior-compartment inhabiting both the right-fin and the left-fin, a storage-port perforating the interior-compartment;

a fastener-aperture proximate to the concavity, the fastener-aperture not perforating the interior-compartment;

a U-shaped fastener having an extension-member, a tail-link angled relative to the extension-member, and a boat-link angled relative to the extension-member, the U-shaped fastener being unitary and substantially rigid;

and a storage-cover able to fasten to and seal closed the storage-port, such that the storage-cover is watertight against the interior-compartment when coupled to the storage-port, the interior-compartment being watertight when the storage-cover is fastened to the storage-port wherein the right-fin and the left-fin are each characterized by curvatures that are concave toward each other;

placing the storage-container rearwardly to the kayak;

aligning the fastener-aperture and a fastener with a hole in the stern of the kayak;

inserting the fastener through both the fastener-aperture and the stern of the kayak;

and threading the fastener to attach the storage-container to the kayak.

* * * * *